US006390876B2

(12) United States Patent
Benz et al.

(10) Patent No.: US 6,390,876 B2
(45) Date of Patent: May 21, 2002

(54) COMPOSITE X-RAY TARGET

(75) Inventors: Mark Gilbert Benz, Burnt Hills; Charles Gitahi Mukira, Clifton Park; Thomas Robert Raber, Schenectady; Constantinos Minas, Slingerlands, all of NY (US); Gregory Alan Steinlage, Milwaukee, WI (US); Gregory Reznikov, Akron, OH (US); Wayne Charles Hasz, Pownal, VT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/846,848

(22) Filed: May 1, 2001

Related U.S. Application Data

(62) Division of application No. 09/466,029, filed on Dec. 17, 1999, now Pat. No. 6,256,376.

(51) Int. Cl.[7] ..... H01J 9/02
(52) U.S. Cl. ..... 445/28
(58) Field of Search ..... 445/28; 378/144

(56) References Cited

U.S. PATENT DOCUMENTS

| | | | | | |
|---|---|---|---|---|---|
| 3,790,838 | A | * | 2/1974 | Baum | 378/144 |
| 4,670,895 | A | * | 6/1987 | Penato et al. | 378/144 |
| 4,777,643 | A | * | 10/1988 | Devine, Jr. | 378/144 |
| 5,498,186 | A | * | 3/1996 | Benz et al. | 445/28 |
| 5,655,000 | A | * | 8/1997 | Benz et al. | 378/144 |
| 5,699,401 | A | * | 12/1997 | Jackson et al. | 378/144 |

* cited by examiner

*Primary Examiner*—Kenneth J. Ramsey
(74) *Attorney, Agent, or Firm*—Paul J. DiConza; Donald S. Ingraham

(57) ABSTRACT

An X-ray tube anode comprises a graphite ring, a target substrate applied onto the graphite ring and a target focal track applied onto the target substrate. The target focal track comprises a first refractory metal and the target substrate comprises a second refractory metal and at least one layer of a material that is characterized by characterized by a coefficient of thermal expansion (CTE) that is the same as the CTE of the target focal track or is intermediate between the CTE of the target focal track and the CTE of the substrate.

8 Claims, 4 Drawing Sheets

COMPOSITE X-RAY TARGET

This application is a division of application Ser. No. 09/466,029, filed Dec. 17, 1999, now U.S. Pat. No. 6,256, 376, which is hereby incorporated by reference in its entirety.

BACKGROUND OF THE INVENTION

The present invention relates to a high performance X-ray generating target. More particularly, the invention is directed to an X-ray anode that resists target substrate debonding.

X-rays are produced when electrons are released in a vacuum within an X-ray tube, accelerated and then abruptly stopped. The electrons are initially released from a heated, incandescent filament. A high voltage between an anode and cathode accelerates the electrons and causes them to impinge upon the anode. The anode, usually referred to as the target, can be a rotating disc type so that the electron beam constantly strikes a different point on the target surface. Typically, a rotating target is made up of a focal track that is bonded to a metal substrate along an interface. The substrate is bonded to a graphite ring. The incidence of high-energy electrons generates large amounts of heat. Unless quickly extracted, the heat can damage the focal track. The metal substrate removes heat away from the focal track and into the graphite ring, which acts a heat sink. The heat is removed from the graphite ring into the surrounding environment.

The X-ray tube contains both the anode assembly and a cathode assembly. The anode assembly includes the rotating disk target and a rotor that is part of a motor assembly that spins the target. A stator is provided outside the X-ray tube vacuum envelope, overlapping about two-thirds of the rotor. The X-ray tube is enclosed in a protective casing having a window for the X-rays that are generated to escape the tube. The casing is filled with oil to absorb heat produced by the X-rays.

Typically the substrate is a refractory metal and the target focal track is an X-ray emitting metal. Tungsten alone and tungsten alloyed with other metals are commonly used in X-ray targets. Metals, which are sometimes alloyed with the tungsten in small amounts, include rhenium, osmium, irridium, platinum, technetium, ruthenium, rhodium and palladium. X-ray targets formed wholly from tungsten or from tungsten alloys where tungsten is the predominant metal are characterized by high density and weight. Additionally, tungsten is notch sensitive and extremely brittle and is thereby subject to catastrophic failure. Because of these shortcomings, X-ray targets typically comprise a tungsten or tungsten alloy target focal track and a target substrate of another metal or alloy. Typically, molybdenum and molybdenum alloy are used for the target substrate.

The target focal track and the target substrate can have different coefficients of thermal expansion (CTE's). For example, a molybdenum or molybdenum alloy substrate can have a higher coefficient of thermal expansion than either the focal track or the graphite backing. The molybdenum or molybdenum alloy substrate expands more than either the tungsten or graphite when subjected to a heating cycle. Thus during tube operation, high stresses are generated at the focal track/substrate interface and at the substrate/graphite interface. Unequal thermal expansion of the target focal track, target substrate and graphite backing coupled with centrifugal force during operation imparts a bending moment to the substrate that tends to move the outer edge of the substrate away from its graphite ring. The target substrate can crack or otherwise weaken and debond from the graphite ring. Thus, there is a need for an X-ray target that resists debonding at the target substrate/target graphite ring interface.

SUMMARY OF THE INVENTION

The invention provides an improved X-ray tube anode that resists debonding between substrate and target graphite ring. The X-ray tube anode comprises a target substrate that has at least one insert layer that is characterized by a coefficient of thermal expansion (CTE) that is the same as a CTE of the target focal track or is intermediate between the CTE of the target focal track and a CTE of the substrate.

In another embodiment, the invention relates to an X-ray tube having an anode that comprises a target substrate that has at least one insert layer that is characterized by a coefficient of thermal expansion (CTE) that is the same as a CTE of the target focal track or is intermediate between the CTE of the target focal track and a CTE of the substrate.

In another embodiment, the invention relates to a process of making an X-ray tube anode comprising forming a portion of a target substrate on a graphite ring for producing an X-ray tube anode comprising a graphite ring, substrate and focal track. A layer of a material having a CTE the same as a CTE of a material of the focal track or CTE intermediate between a CTE of a material of the substrate and the CTE of the material of the focal track is applied to the portion of the substrate. Another portion of the target substrate is applied onto the layer and a focal track is applied onto the substrate to produce the X-ray tube anode.

In still another embodiment, an X-ray tube is made by mounting the X-ray tube anode to a rotor, axle and hub assembly.

DETAILED DESCRIPTION OF THE INVENTION

Figure 1:
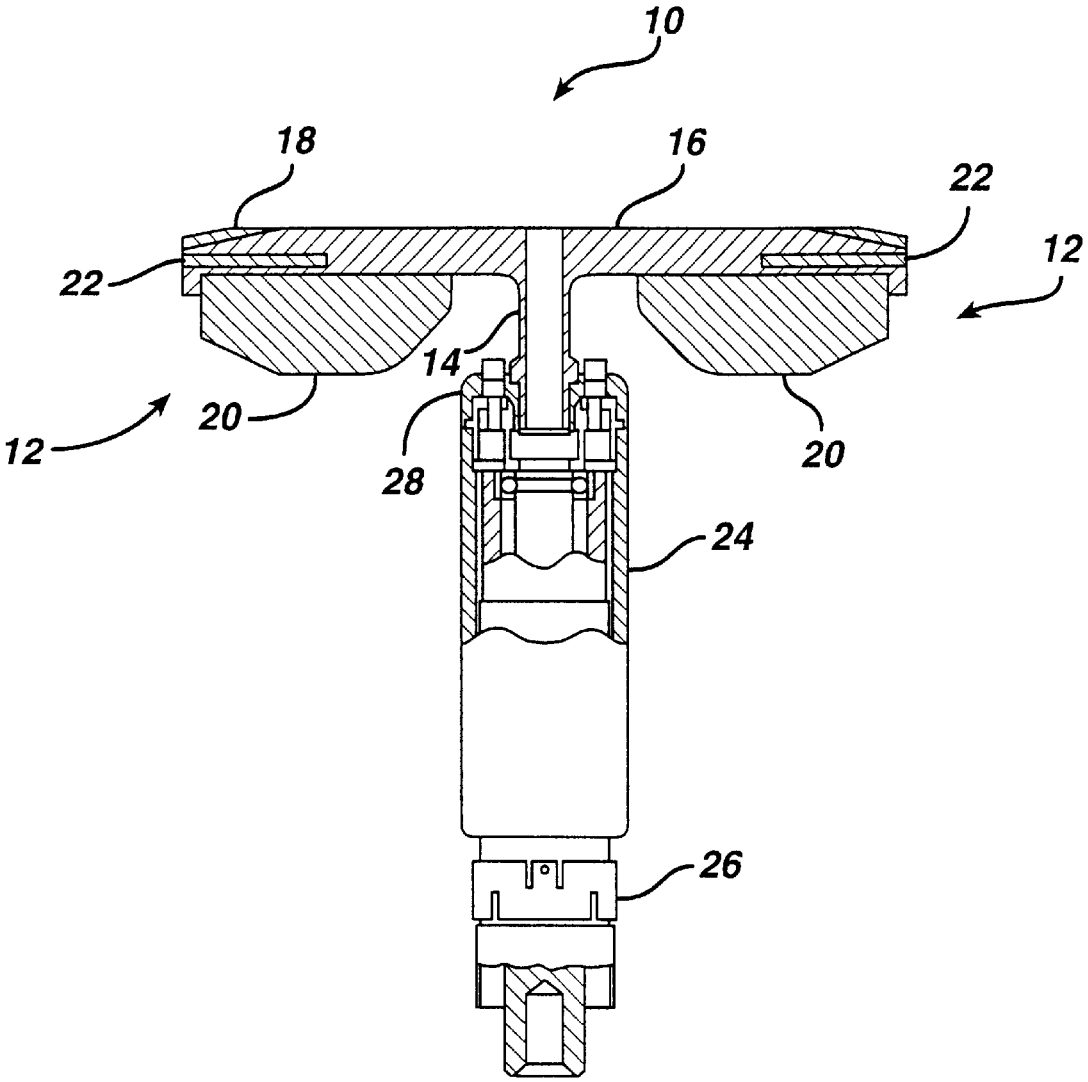
FIG. 1 is a sectional view of an X-ray tube target and stem assembly of the invention.

The CTE for an X-ray target focal track substrate is different from the CTE for both the focal track and the graphite backing. The difference imposes a bending moment on the substrate that tends to move the outer edge of the substrate away from the X-ray target graphite ring. The bending moment causes debonding at the substrate/graphite ring interface. According to the invention, at least one layer of another material is provided as part of the target substrate. The material of the layer is characterized by a CTE that is the same as the CTE of the target focal track or is intermediate between the CTE of the target focal track and the CTE of the substrate. Preferably, the layer is the same material as the target focal track. The inserted CTE layer counters the large expansion of the substrate during tube operation. The lower substrate expansion results in lower stress levels at the substrate/graphite interface. The resulting X-ray target has improved resistance to debonding at the target/graphite ring interface.

The target of the invention can be produced by any suitable process. For example, the X-ray target can be formed by a powder metallurgy technique wherein metal powder to form the target focal track is placed against metal powder to form the target substrate. The resulting powder mass is pressed, sintered and then forged and machined to form the target.

Embodiments of the present invention provide a process of making an X-ray tube anode 12 having a target graphite ring 20, substrate 16 and focal track 18, comprising: forming a portion of the target substrate on the graphite ring 20; applying a layer 22 of a material having a CTE the same as a CTE of a material of the focal track 18 or CTE intermediate between a CTE of a material of the substrate 16 and the CTE of the material of the focal track 18; applying another portion of the target substrate onto the layer; and applying the focal track 18 onto the substrate portions to produce the X-ray tube anode 12. In certain embodiments, the material of the target substrate 16 comprises a titanium-zirconium-molybdenum TZM alloy. Certain embodiments also provide that the material of the focal track 18 comprise tungsten or tungsten alloy. Particular embodiments provide that the process further comprises mounting the X-ray tube anode 12 to rotor 24, axle 26 and hub 28 assembly.

In certain embodiments, the process comprises i) forming a slurry of a solvent and binder with a material having a CTE the same as a CTE of a material of the focal track 18 or CTE intermediate between a CTE of a material of the substrate 16 and the CTE of the material of the focal track 18, ii) casting a uniform film of the slurry onto a surface, and iii) evaporating solvent from the slurry to form the layer 22. In particular embodiments, the process further comprises removing the layer 22 from the surface; and applying the layer 22 to the portion of the X-ray target substrate. In more particular embodiments, the process further comprises forming a pack from the focal track metal applied to the refractory metal target substrate-forming material and sintering the pack to produce the X-ray tube anode 12.

For some embodiments of the present invention, the step of applying the focal track comprises casting a slurry of a metal powder in a solvent containing a binder onto a casting surface; evaporating the solvent from the slurry to produce a flexible tape removably adhering to the casting surface; densifying the tape to increase its green strength; peeling the densified tape from the casting surface; applying the densified tape to the X-ray target substrate portions; and evaporating the binder from the tape at a temperature lower than the melting temperature of the metal and the substrate to form the focal track 18.

In a preferred embodiment, the X-ray target is formed by first casting a slurry of a metal powder in an organic solvent containing a binder onto a casting surface. The organic solvent is evaporated from the slurry to produce a flexible layer removably adhering to the casting surface. The layer is densified to increase its green strength and is then peeled from the casting surface. The densified layer is applied to a surface of an X-ray target substrate and the binder is evaporated from the layer at a temperature lower than the melting temperature of the metal and the substrate to form the X-ray target.

These and other features will become apparent from the drawings which by way of example, without limitation illustrate embodiments of the invention.

Figure 2:
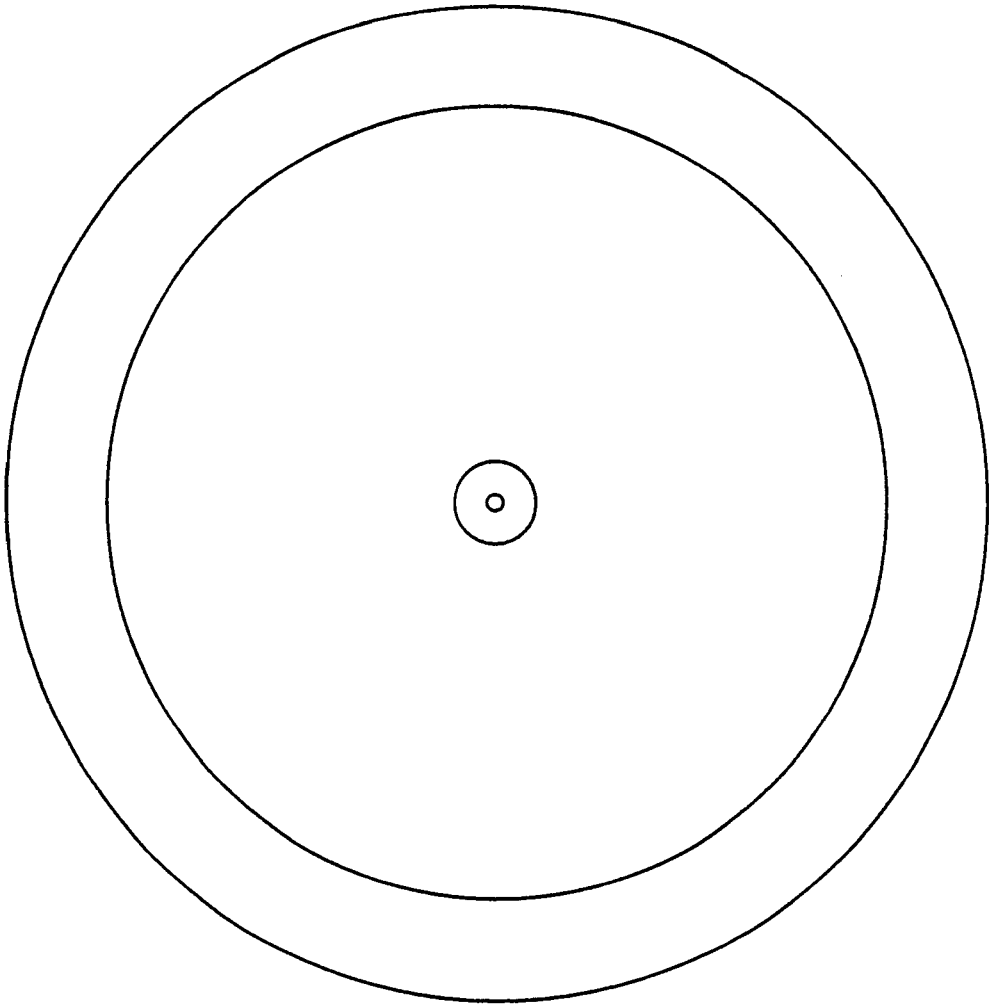
FIG. 2 is a top view of the assembly of FIG. 1 showing the target substrate and focal track.

FIGS. 1 and 2 are schematic views of a representation of an X-ray tube 10 that includes rotating anode assembly 12 and stem 14. The anode assembly 12 includes target substrate 16 typically of molybdenum alloy TZM and target focal track 18 typically made of a tungsten-rhenium alloy. The target substrate 16 is backed by graphite ring 20, which is brazed to target substrate 16. Electrons generated by a cathode (not shown) impinge on focal track 18, which emits X-rays.

The anode assembly 10 is rotated by an induction motor comprising cylindrical rotor built around axle 24. The axle 24 supports disc shaped target substrate 16 with focal track 18 on the front and graphite ring 20 on the back. The anode assembly 12 is connected via a stem 14 and hub 26 to rotor and axle 24, which contains bearings to facilitate rotation. The rotor of the rotating anode assembly 10, driven by a stator induction motor, is at anodic potential while the stator is electrically grounded.

In a typical X-ray tube, the anode and cathode assemblies are sealed in a vacuum frame and mounted in a conductive metal housing. An insulation material is provided between the stator and the glass frame and rotor.

Figure 3:
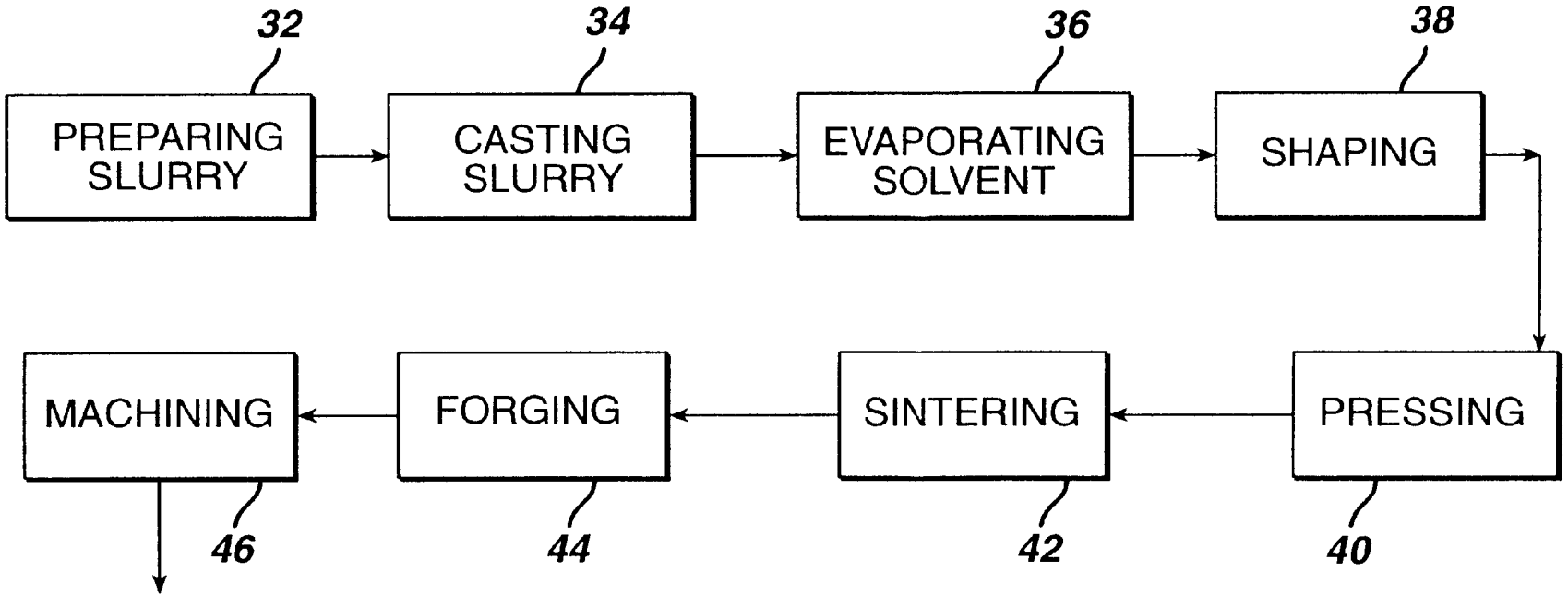
FIG. 3 is a schematic representation of a process of forming an X-ray target.

In accordance with the invention, target focal track 18 is formed on target substrate 16 by a tape cast process. FIG. 3 schematically illustrates a process of making an X-ray target including a first step 32 wherein metal alloy powders are slurried with an inert solvent binder such as a polyethylene oxide or a fully saturated aliphatic such as hexane, heptane or organic or water-based mixture such as polyethylene oxide/water or toluene/polyvinyl butyral and the like that evaporates at about room temperature up to about 200° C. The solvent includes a binder that holds the metal powder together and that burns out cleanly without residue.

The metal powder is preferably tungsten or a tungsten alloy powder such as a tungsten/rhenium (W-Re). However, other suitable metals and alloys such as rhenium, rhodium, molybdenum or other heavy metals can be used. The metals and alloys are selected primarily for their high melting points (>1500° C.). The W-Re is prepared by conventional powder processing techniques. The particle size of the powder should be less than 15 micrometers in diameter.

The metal powder can comprise between about 50 and about 98 weight percent, desirably between about 84 and about 96, and preferably between about 87 and about 94 weight percent of the slurry. The binder can comprise between about 5 and about 20 weight percent, desirably between about 7 and about 16, and preferably between about 8 and about 13 weight percent of the slurry. Various known slurry modifying agents may be employed to control viscosity and other properties as long as they cleanly burn out without residue during sintering. The viscous character of the organic vehicle and fine particle size combine to form relatively stable slurries that resist rapid settling.

Distilled water can be added to the slurry in water-based systems to adjust viscosity to provide a smooth consistency suitable for casting. The distilled water can be slowly added while slurry consistency is observed until the slurry can flow when tilted at a 45° angle off vertical. The slurry can be de-aired. De-airing can be performed during initial mixing of the slurry in a vacuum mixing device. Vacuum level can be less than 1 atmosphere, typically less than about 1.0E-02 Torr.

The slurry can then be cast 34 onto a casting surface, which is preferably a polytetrafluoroethylene (Teflon®), a glycol, terephthalic acid polyester (Mylar®), a cellophane or a cellulose acetate. Any spreader device for regulating amount of viscous material deposited on a surface can cast the slurry. For example, a doctor blade with a roller device is suitable. Suitable doctor blade equipment is provided by HED International, ProCast Division and other manufacturers. The slurry can be poured onto a surface and the blade then passed through the slurry for leveling or the slurry can be fed into a doctor blade device and applied under the blade edge to create a flat ribbon of tape with a width dimension greater than a desired diameter of a focal track.

The process can include other steps such as milling and filtering, if necessary or desired. Additionally, other processes for forming a green tape can be used, including roll compaction, slip casting, slurry spraying, thermal spraying and waterfall casting.

Solvent is evaporated 36 from the cast slurry to produce a flexible layer removably adhering to the casting surface. The evaporation rate can be controlled by controlling humidity to avoid cracking. For example, the humidity can be controlled at about 85% to about 95% at room temperature by enveloping the drying layer in an enclosure to induce higher humidity or by using a counter flow of air confined to a small area to induce a lower humidity. A slow evaporation rate is preferred. When the slurry is prepared with deionized water, evaporation can be carried out at a temperature less than about 93° C. Preferably, the evaporation is carried out at about room temperature (26° C.). A flawless flat layer is provided after evaporation.

The surface and cast layer are sufficiently flexible that they can be handled or stored as a unit or immediately shaped 38 by trimming. Preferably, the layer is trimmed to an annular shape to provide layers for direct pressing as a target focal track. In one aspect, annular rings of appropriate size can be punched from the layer by a die press or the like. After shaping, the layer is peeled from the casting surface and formed into a focal track on a target substrate. Preferably, the layer in an annular shape is placed in a pressing die such as a standard hydraulic pressing die target capable of applying a 1500 ton or less pressure. A metal powder to form the target substrate can be placed on top of the annular layer and pressed 40 to form a pack. Molybdenum alloys like titanium-zirconium-molybdenum (TZM) are suitable metals to form the target substrate. The pack can be compressed in the die by application of a compression force typically of between about 32 tons/cm$^2$ and about 226 tons/cm$^2$, desirably between about 65 tons/cm$^2$ and about 194 tons/cm$^2$ and preferably between about 97 tons/cm$^2$ and about 162 tons/cm$^2$.

In one embodiment of the invention, an annular ring die can be used to contain a thick ring of cast metal. After leveling and drying, the ring can be removed and the thick ring used for further processing to create a thick layer that can be used in the pressing die in place of multiple thin layers for the formation of thick focal tracks.

Next, the compressed pack can be sintered 42 to burn out binder. The pack can be placed in a suitable furnace, such as a hydrogen or vacuum furnace, and subjected to a temperature of between about 2000° C. to about 2200° C. for a period of between about 5 hours and about 10 hours in vacuum, of 10 to 20 microns.

The pack is then pre-heated at 1500° C. in a hydrogen atmosphere and then forged 44 on a mechanical press. Typically the forging step is carried out in a press with applied force of about 400 tons/cm$^2$ to about 800 tons/cm$^2$. The X-ray target is then removed from the forging die.

The following examples illustrate the invention.

EXAMPLE 1

Figure 4:
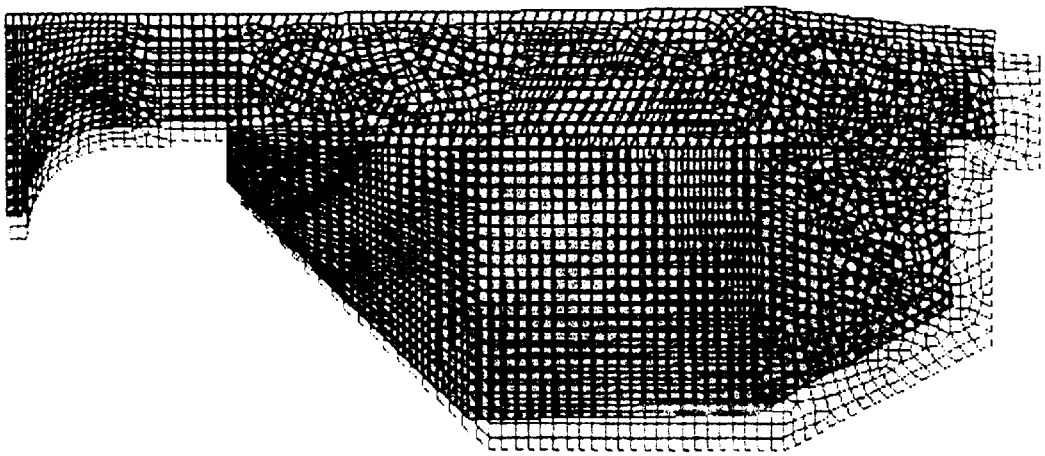
FIG. 4 is a displacement plot of a target and graphite ring without an additional target insert layer that was generated by computer simulation of target response to X-ray tube operation.
Figure 5:
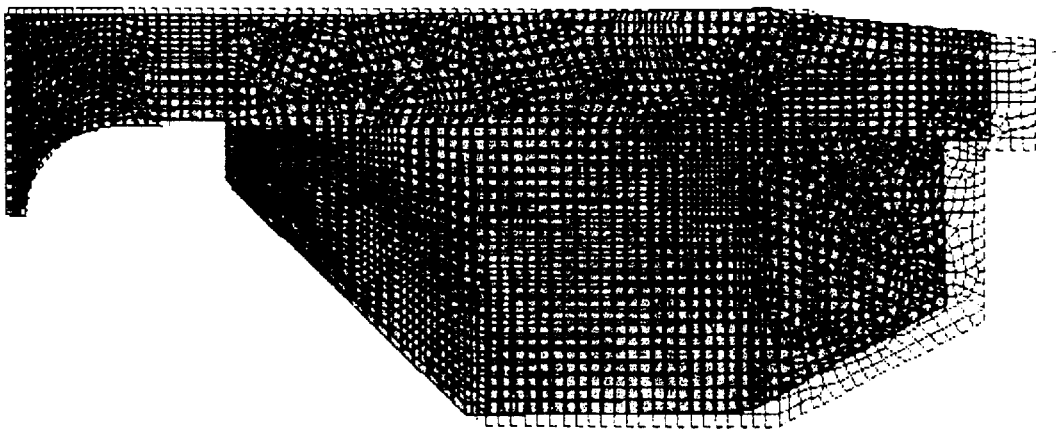
FIG. 5 is a displacement plot of a target and graphite ring with an additional target insert layer according to the invention that was generated by computer simulation of the target response to X-ray tube operation.

Two configurations were modeled in ANSYS. ANSYS is a computer code that is used to simulate materials behavior when subjected to thermo-mechanical stresses such as tube operation. Displacement plots were obtained for the configurations and are shown in FIGS. 4 and 5. A comparison of FIGS. 3 and 4 shows that inserting a layer having lower CTE than the substrate CTE reduces amount of displacement the target undergoes during tube operation. The results of the modeling analysis are summarized in the following Table.

TABLE

| Design | Min | Max | Avg |
|---|---|---|---|
| Initial (mm) | 0.215 | 0.558 | 0.3865 |
| Strongback (mm) | −0.145 | 0.207 | 0.031 |

The results clearly show that the configuration of the invention results in a lower bending displacement.

While preferred embodiments of the invention have been described, the present invention is capable of variation and modification and therefore should not be limited to the precise details of the examples. The invention includes changes and alterations that fall within the purview of the following claims.

What is claimed:

1. A process of making an X-ray tube anode having a target graphite ring, substrate and focal track, comprising:

forming a portion of said target substrate on said graphite ring;

applying a layer of a material having a CTE the same as a CTE of a material of said focal track or CTE intermediate between a CTE of a material of said substrate and said CTE of said material of said focal track;

applying another portion of said target substrate onto said layer; and applying said focal track onto said substrate portions to produce said X-ray tube anode.

2. The process of claim 1, comprising:

(i) forming a slurry of a solvent and binder with a material having a CTE the same as a CTE of a material of said focal track or CTE intermediate between a CTE of a material of said substrate and said CTE of said material of said focal track, (ii) casting a uniform film of said slurry onto a surface, and (iii) evaporating solvent from said slurry to form said layer.

3. The process of claim 1, comprising (i) forming a slurry of a solvent and binder with a material having a CTE the same as a CTE of a material of said focal track or CTE intermediate between a CTE of a material of said substrate and said CTE of said material of said focal track, (ii) casting a uniform film of said slurry onto a surface, and (iii) evaporating solvent from said slurry to form said layer;

removing said layer from said surface; and applying said layer to said portion of said X-ray target substrate.

4. The process of claim 3 further comprising forming a pack from said focal track material applied to said refractory metal target substrate-forming material and sintering said pack to produce said X-ray tube anode.

5. The process of claim 1, wherein said step of applying said focal track comprises:

casting a slurry of a metal powder in a solvent containing a binder onto a casting surface;

evaporating said solvent from the slurry to produce a flexible tape removably adhering to the casting surface;

densifying the tape to increase its green strength;

peeling the densified tape from the casting surface;

applying the densified tape to said X-ray target substrate portions; and evaporating said binder from said tape at a temperature lower than the melting temperature of said metal and said substrate to form said focal track.

6. The process of claim 1 wherein said material of said target substrate comprises a titanium-zirconium-molybdenum alloy.

7. The process of claim 1 wherein said material of said focal track comprises tungsten or tungsten alloy.

8. A process of making an X-ray tube comprising making an X-ray tube anode according to claim 1 and mounting said X-ray tube anode to rotor, axle and hub assembly.

* * * * *